US010319302B2

(12) United States Patent
Ma et al.

(10) Patent No.: US 10,319,302 B2
(45) Date of Patent: Jun. 11, 2019

(54) PIXEL CIRCUIT, DRIVING METHOD THEREOF AND DISPLAY DEVICE

(71) Applicant: BOE TECHNOLOGY GROUP CO., LTD., Beijing (CN)

(72) Inventors: Zhanjie Ma, Beijing (CN); Liang Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 805 days.

(21) Appl. No.: 14/908,835

(22) PCT Filed: Aug. 20, 2015

(86) PCT No.: PCT/CN2015/087636
§ 371 (c)(1),
(2) Date: Jan. 29, 2016

(87) PCT Pub. No.: WO2016/150087
PCT Pub. Date: Sep. 29, 2016

(65) Prior Publication Data

US 2017/0039944 A1 Feb. 9, 2017

(30) Foreign Application Priority Data

Mar. 25, 2015 (CN) ..... 2015 1 0134662

(51) Int. Cl.
*G09G 3/325* (2016.01)
*G09G 3/3233* (2016.01)
(Continued)

(52) U.S. Cl.
CPC ..... *G09G 3/3258* (2013.01); *G09G 3/325* (2013.01); *G09G 3/3233* (2013.01);
(Continued)

(58) Field of Classification Search
CPC .... G09G 3/3258; G09G 3/3233; G09G 3/325; G09G 3/3266; G09G 3/3291;
(Continued)

(56) References Cited

U.S. PATENT DOCUMENTS

2014/0152191 A1* 6/2014 Yang ..... G09G 3/3233 315/240

FOREIGN PATENT DOCUMENTS

CN 102456318 A 5/2012
CN 103021331 A 4/2013
(Continued)

OTHER PUBLICATIONS

International Search Report forms 210, 220, 237 dated Dec. 16, 2015, in corresponding International Application No. PCT/CN2015/087636 along with English translation of Written Opinion.

*Primary Examiner* — Charles V Hicks
(74) *Attorney, Agent, or Firm* — Nath, Goldberg & Meyer; Joshua B. Goldberg; Tanya E. Harkins

(57) ABSTRACT

The present invention provides a pixel circuit, a driving method thereof and a display device which are related to the field of display technology. The pixel circuit comprises a reset module, a compensation module, an energy storage module, a drive module, a drive control module, a power supply module and a light emitting module, the input voltage of the third power supply signal terminal is larger than the difference between the input voltage of the data signal terminal and the threshold voltage of the drive module, and is less than the input voltage of the second power supply signal terminal. The present invention is capable of discharging the driving transistor to a potential Vth within a short period, ensuring the driving transistor to be discharged completely in a short time.

20 Claims, 6 Drawing Sheets

(51) Int. Cl.
*G09G 3/3258* (2016.01)
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2300/0809* (2013.01); *G09G 2300/0819* (2013.01); *G09G 2300/0842* (2013.01); *G09G 2300/0861* (2013.01); *G09G 2310/0262* (2013.01); *G09G 2320/0233* (2013.01); *G09G 2320/045* (2013.01); *G09G 2320/0646* (2013.01)

(58) Field of Classification Search
CPC ... G09G 2300/0809; G09G 2320/0233; G09G 2320/0646; G09G 2300/0819; G09G 2300/0842; G09G 2300/0861; G09G 2310/0262; G09G 2320/045
See application file for complete search history.

(56) References Cited

FOREIGN PATENT DOCUMENTS

| | | | |
|---|---|---|---|
| CN | 103280182 | A | 9/2013 |
| CN | 104021757 | A | 9/2014 |
| CN | 203882587 | U | 10/2014 |
| CN | 104157240 | A | 11/2014 |
| CN | 204029330 | U | 12/2014 |
| CN | 104700776 | A | 6/2015 |
| KR | 1020080025591 | A | 3/2008 |

* cited by examiner

PIXEL CIRCUIT, DRIVING METHOD THEREOF AND DISPLAY DEVICE

This is a National Phase Application filed under 35 U.S.C. 371 as a national stage of PCT/CN2015/087636 filed Aug. 20,2015, an application claiming the benefit of Chinese Application No. 201510134662.2 filed on Mar. 25, 2015, the content of each of which is hereby incorporated by reference in its entirety.

FIELD OF THE INVENTION

The present invention relates to the field of display technology, in particular to a pixel circuit, a driving method thereof and a display device.

BACKGROUND OF THE INVENTION

With the development of display technology, an OLED (Organic Light Emitting Diode), which is a current-controlled light-emitting device, has being increasingly applied in the field of high-performance display, due to the characteristics such as self-illumination, fast response, wide viewing angle and capability of being fabricated on flexible substrate.

The OLED pixel circuit has a circuit structure for driving the organic light emitting diode to emit light by controlling current using a driving transistor. In order to eliminate the influence of uneven threshold voltage of the driving transistor, typically the circuit structure of the pixel circuit the organic light emitting diode further comprises a module for compensating the threshold voltage. The OLED pixel circuit compensates the OLED pixels through a reset phase, a compensation potential writing phase and a light emitting phase, a driving transistor connected to the OLED is discharged till it is turned off in the compensation potential writing phase, thereby the driving transistor is discharged to a potential Vth (threshold voltage).

However, with the improvement of the resolution, the driving transistor is required to be discharged within a short period, and discharging of the driving transistor has a specific function of time, the driving transistor may be insufficiently discharged with a short discharging time, and a preset display brightness of the OLED may not be achieved.

SUMMARY OF THE INVENTION

In order to discharge the driving transistor to a potential Vth within a short period, the present invention provided a pixel circuit, a driving method thereof and a display device.

As a first aspect, there is provided a pixel circuit comprising: a reset module, a compensation module, an energy storage module, a drive module, a drive control module, a power supply module and a light emitting module, the reset module is connected to a first power supply signal terminal, a second power supply signal terminal, a first control signal terminal, a first control point and a second control point, and is configured for writing an input voltage of the first power supply signal terminal into the second control point and writing an input voltage of the second power supply signal terminal into the first control point according to a control signal input to the first control signal terminal;

the compensation module is connected to the first control signal terminal, a third power supply signal terminal and a third control point, and is configured for writing an input voltage of the third power supply signal terminal into the third control point according to the control signal input to the first control signal terminal;

the drive control module is connected to the first power supply signal terminal, a second control signal terminal, a third control signal terminal, a data signal terminal, the second control point and a fourth control point, and is configured for writing an input voltage of the data signal terminal into the fourth control point according to a control signal input to the third control signal terminal;

the power supply module is connected to the second power supply signal terminal, the second control signal terminal and the first control point, and is configured for providing the voltage on the first power supply signal terminal to the first control point according to a control signal input to the second control signal terminal;

the drive module is connected to the first control point, the third control point and the fourth control point, and is discharged under control of the voltages on the first control point, the third control point and the fourth control point;

the energy storage module is connected to the first control point and the second control point, and is configured for storing the voltages on the first control point and the second control point;

the light emitting module is connected to the third control point and the fourth power supply signal terminal, and is configured for emitting light under control of the voltages on the third control point and the fourth power supply signal terminal;

wherein the input voltage of the third power supply signal terminal is larger than a difference between the input voltage of the data signal terminal and a threshold voltage of the drive module, and is less than the input voltage of the second power supply signal terminal.

Optionally, the reset module comprises: a first transistor and a second transistor, a first electrode of the first transistor is connected to the first power supply signal terminal, a second electrode of the first transistor is connected to the second control point, and a gate of the first transistor is connected to the first control signal terminal; and a first electrode of the second transistor is connected to the second power supply signal terminal, a second electrode of the second transistor is connected to the first control point, and a gate of the second transistor is connected to the first control signal terminal.

Optionally, the compensation module comprises: a third transistor, and a first electrode of the third transistor is connected to the third power supply signal terminal, a second electrode of the third transistor is connected to the third control point, and a gate of the third transistor is connected to the first control signal terminal.

Optionally, the drive control module comprises: a fourth transistor, a fifth transistor and a sixth transistor, a first electrode of the fourth transistor is connected to the first power supply signal terminal, a second electrode of the fourth transistor is connected to the second control point, and a gate of the fourth transistor is connected to the third control signal terminal;

a first electrode of the fifth transistor is connected to the second control point, a second electrode of the fifth transistor is connected to the fourth control point, and a gate of the fifth transistor is connected to the second control signal terminal; and a first electrode of the sixth transistor is connected to the fourth control point, a second electrode of the sixth transistor is connected to the data signal terminal, a gate of the sixth transistor is connected to the third control signal terminal.

Optionally, the power supply module comprises: a seventh transistor, and a first electrode of the seventh transistor is connected to the second power supply signal terminal, a second electrode of the seventh transistor is connected to the first control point, and a gate of the seventh transistor is connected to the second control signal terminal.

Optionally, the drive module comprises: an eighth transistor, and the threshold voltage of the drive module is a threshold voltage of the eighth transistor, a first electrode of the eighth transistor is connected to the first control point, a second electrode of the eighth transistor is connected to the third control point, and a gate of the eighth transistor is connected to the fourth control point.

Optionally, the energy storage module comprises: a capacitor, and one terminal of the capacitor is connected to the first control point, and the other terminal of the capacitor is connected to the second control point.

Optionally, the light emitting module comprises: an organic light emitting diode, one terminal of the organic light emitting diode is connected to the third control point, and the other terminal of the organic light emitting diode is connected to the fourth power supply signal terminal.

Optionally, the first power supply signal terminal is grounded.

Optionally, all of the transistors are N-type transistors; or all of the transistor are P-type transistors.

Optionally, when the transistor is a P-type transistor, a first electrode of the transistor is the source, and the second electrode of the transistor is the drain.

As a second aspect, there is provided a driving method for the pixel circuit according to the first aspect, the pixel circuit comprising: a reset module, a compensation module, an energy storage module, a drive module, a drive control module, a power supply module and a light emitting module, the driving method for the pixel circuit comprising the following steps:

a turning on control signal is input to the first control signal terminal, a first voltage is input to the first power supply signal terminal, a second voltage is input to the second power supply signal terminal, and a third voltage is input to the third power supply signal terminal, so that the first voltage is written into the second control point, the second voltage is written into the first control point, and the third voltage is written into the third control point;

a turning off control signal is input to the first control signal terminal, a turning on control signal is input to the third control signal terminal, a data voltage is input to the data signal terminal, and the first voltage is input to the first power supply signal terminal, so that the data voltage is written into the fourth control point, the first voltage is written into the second control point, and the drive module is discharged via the light emitting module under control of the voltages on the first control point and the fourth control point;

the turning off control signal is input to the third control signal terminal, a turning on control signal is input to the second control signal terminal, and the second voltage is input to the second power supply signal terminal, so that the second voltage is written into the first control point, and the light emitting module is driven by the current of the drive module to emit light;

wherein the third voltage is larger than a difference between the data voltage and the threshold voltage of the drive module, and is less than the second voltage.

Optionally, the reset module comprises the first transistor and the second transistor, the compensation module comprises the third transistor, the drive control module comprises the fourth transistor, the fifth transistor and the sixth transistor, the power supply module comprises the seventh transistor, the drive module comprises the eighth transistor, the threshold voltage of the drive module is the threshold voltage of the eighth transistor, the energy storage module comprises the capacitor, the light emitting module comprises the organic light-emitting diode, when the turning on control signal is input to the first control signal terminal, the first transistor, the second transistor and the third transistor are turned on;

when the turning off control signal is input to the first control signal terminal, the first transistor, the second transistor and the third transistor are turned off;

when the turning on control signal is input to the third control signal terminal, the fourth transistor and the sixth transistor are turned on;

when the turning off control signal is input to the third control signal terminal, the fourth transistor and the sixth transistor are turned off; when the turning on control signal is input to the second control signal terminal, the fifth transistor and the seventh transistor are turned on.

Optionally, the first power supply signal terminal is grounded.

Optionally, all of the transistors are N-type transistors; or all of the transistor are P-type transistors.

Optionally, when the transistor is a P-type transistor, a first electrode of the transistor is a source, and the second electrode of the transistor is a drain.

Optionally, when the transistors are P-type transistors, the timing sequence of the control signal includes:

a first phase: the first control signal terminal is at a low level, the second control signal terminal and the third control signal terminal are at a high level, the first voltage is input to the first power supply signal terminal, the second voltage is input to the second power supply signal terminal, the third voltage is input to the third power supply signal terminal, the third voltage is larger than the threshold voltage of the eighth transistor, and less than the second voltage;

a second phase: the third control signal terminal is at a low level, the first control signal terminal and the second control signal terminal are at a high level, a data voltage is input to the data signal terminal, and the first voltage is input to the first power signal terminal;

a third stage: the second control signal terminal is at a low level, the first control signal terminal and the third control signal terminal are at a high level, and the second voltage is input to the second power signal terminal.

As a third aspect, there is provided a display device comprising the pixel circuit according to the first aspect.

The present invention provides a pixel circuit, a driving method thereof and a display device, the input voltage of the second power supply signal terminal is written into the first control point by the reset module, the input voltage of the third power supply signal terminal is written into the third control point by the compensation module, and the input voltage of the data signal terminal is written into the fourth control point by the drive control module, so that the drive module is discharged under control of the voltages on the first control point, the third control point and the fourth control point, since the input voltage of the third power supply signal terminal is larger than the difference between the input voltage of the data signal terminal and the threshold voltage of the drive module, and less than the input voltage of the second power supply signal terminal, the voltage on the drive module is pre-compensated utilizing a voltage pre-compensation principle, thereby discharging of the drive module to the potential Vth is sped up, the time for discharging the drive module to the potential Vth is shortened, therefore it is ensured that the drive module can be discharged completely within a short period.

It should be understood that both the foregoing general description and the later detailed description are only exemplary and illustrative, without limiting the present invention.

BRIEF DESCRIPTION OF THE DRAWINGS

In order to illustrate the technical solutions in the embodiments of the present invention more clearly, the accompanying drawings for the embodiments will be briefly described in the following. Apparently, the drawings to be described are only a part of the embodiments, and for those of ordinary skilled in the art, other embodiments can be obtained based on these drawings without creative efforts.

The specific embodiments of the present invention are illustrated through the above drawings, and will be described hereinafter with more detail. These figures and text description are not intended to limit the scope of the inventive concept by any means, but to explain the concept of the present invention for those skilled in the art with reference to the specific embodiments.

DETAILED DESCRIPTION OF THE EMBODIMENTS

The object, solutions and advantages of the present invention will become apparent through the detailed description to the embodiments below with reference to the accompanying drawings.

Any transistor employed in the embodiments of the present invention may be a thin film transistor or field effect transistor or any other element having like characteristics. According to the functions in the circuit, the transistors used in the embodiments of the present invention are mainly switching transistors. Herein, since the source and drain of the switching transistor is symmetrical, the source and drain are interchangeable. In the embodiments of the present invention, in order to distinguish the two electrodes except the gate electrode, the source electrode is referred to as a first electrode, and the drain electrode is referred to as a second electrode. Based on the shape in the figures, the central terminal of the transistor is defined as gate, the signal input terminal is defined as the source, and the signal output terminal is defined as the drain. Furthermore, the switching transistor employed in the embodiments of the present invention may be a P-type switching transistor or an N-type switching transistor, wherein the P-type switching transistor is turned on when the gate is at a low level, and turned off when the gate is at a high level, the N-type switching transistor is turned on when the gate is at a high level, and turned off when the gate is at a low level. The driving transistor may also be of P-type or N-type, wherein a P-type driving transistor is in an amplifying state or a saturation state when the gate is at a low level (the gate voltage is less than the source voltage), and the absolute value of the gate-source voltage is larger than a threshold voltage; an N-type driving transistor is in an amplifying state or a saturation state when the gate is at a high level (the gate voltage is larger than the source voltage), and the absolute value of the gate-source voltage is larger than a threshold voltage.

Figure 1:
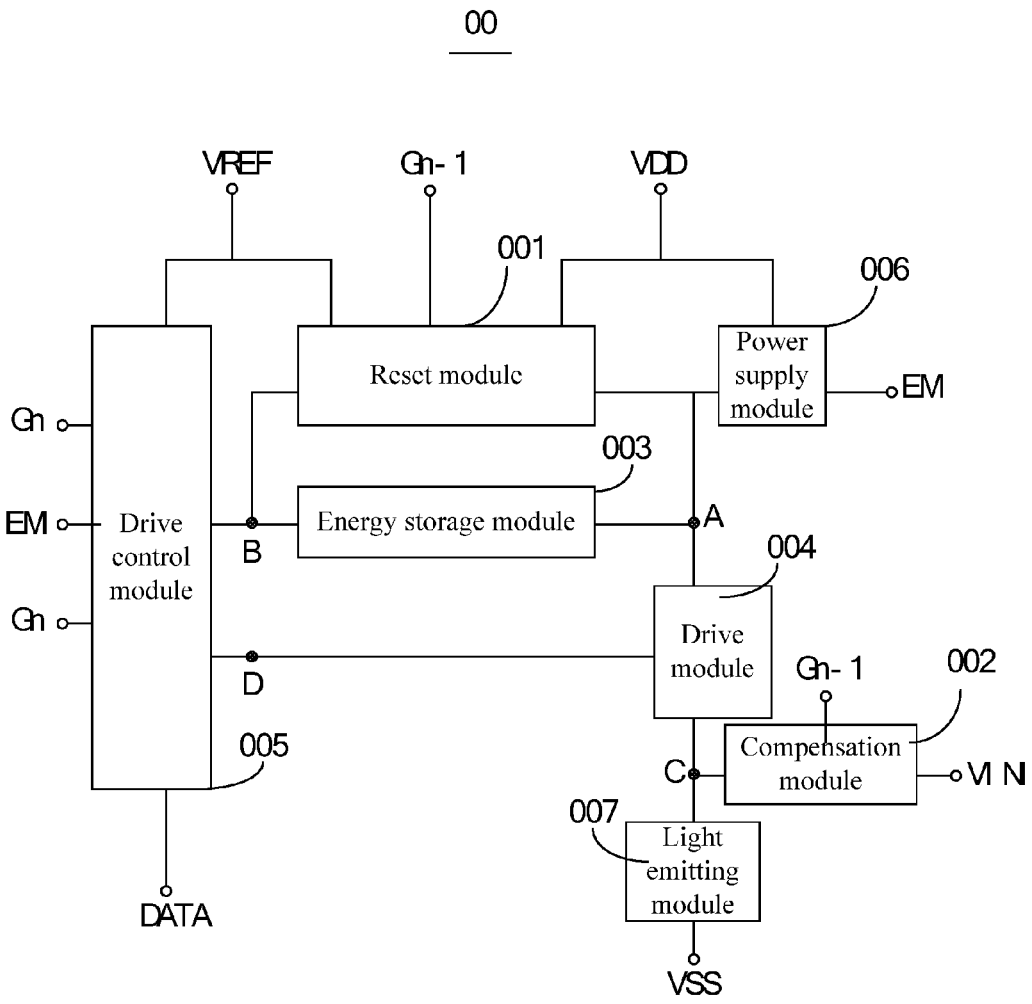
FIG. 1 is a schematic structural view of a pixel circuit according to an embodiment of the present invention.

As shown in FIG. 1, the present invention provides a pixel circuit 00 comprising: a reset module 001, a compensation module 002, an energy storage module 003, a drive module 004, a drive control module 005, a power supply module 006 and a light emitting module 007.

The reset module 001 is connected to a first power supply signal terminal VREF, a second power supply signal terminal VDD, a first control signal terminal Gn-1, a first control point A and a second control point B, and the reset module 001 is configured for writing the input voltage of the first power supply signal terminal VREF into the second control point B and writing the input voltage of the second power supply signal terminal VDD into the first control point A according to the control signal input to the first control signal terminal Gn-1.

The compensation module 002 is connected to the first control signal terminal Gn-1, a third power supply signal terminal VINI and a third control point C, and the compensation module 002 is configured for writing the input voltage of the third power supply signal terminal VINI into the third control point C according to the control signal input to the first control signal terminal Gn-1.

The drive control module 005 is connected to the first power supply signal terminal VREF, a second control signal terminal EM, a third control signal terminal Gn, a data signal terminal DATA, the second control point B and a fourth control point D, and the drive control module 005 is configured for writing the input voltage of the data signal terminal DATA into the fourth control point D according to the control signal input to the third control signal terminal Gn.

The power supply module 006 is connected to the second power supply signal terminal VDD, the second control signal terminal EM and the first control point A, and the power supply module 006 is configured for providing the voltage on the first power supply signal terminal VREF to the first control point A according to the control signal input to the second control signal terminal EM.

The drive module 004 is connected to the first control point A, the third control point C and the fourth control point D, and the drive module 004 is configured for discharging under control of the voltages on the first control point A, the third control point C and the fourth control point D.

The energy storage module 003 is connected to the first control point A and the second control point B, for storing the voltages on the first control point A and the second control point B.

The light emitting module 007 is connected to the third control point C and the fourth power supply signal terminal VSS, for emitting light under control of the voltages on the third control point C and the fourth power supply signal terminal VSS.

Note that the input voltage of the third power supply signal terminal VINI may be larger than the difference between the input voltage of the data signal terminal DATA and the threshold voltage of the drive module 004, and less than the input voltage of the second power supply signal terminal VDD.

The voltage pre-compensation principle refers to discharging from a high voltage terminal to a low voltage terminal, so that the voltage on the high voltage terminal becomes a predetermined voltage. Before the discharging of the high voltage terminal, if a voltage larger than the predetermined voltage and less than the voltage on the high voltage terminal is set on the low voltage terminal, then the discharging from the high voltage terminal to the predetermined voltage will be sped up when the high voltage terminal is discharged. In an embodiment of the present invention, the voltage on the first control point A is the input voltage of the second power supply signal terminal VDD, if the drive module 004 is discharged to a threshold voltage, the voltage on the first control point A shall be discharged to a difference between the input voltage of the data signal terminal DATA and the threshold voltage of the drive module 004. The input voltage of the third power supply signal terminal VINI is written into the third control point C, the input voltage of the third power supply signal terminal VINI is larger than the difference between the input voltage of the data signal terminal DATA and the threshold voltage of the drive module 004, and less than the input voltage of the second power supply signal terminal VDD.

According to the voltage pre-compensation principle, the first control point A is the high voltage terminal, the third control point C is the low voltage terminal, the difference between the input voltage of the data signal terminal DATA and the threshold voltage of the drive module 004 is the predetermined voltage for discharging of the first control point A, and the voltage on the third control point C is larger than the predetermined voltage and less than the voltage on the high voltage terminal. Therefore, when the drive module 004 is discharged to the threshold voltage, the discharging of the first control point A to the predetermined voltage will be sped up, i.e. the discharging of the drive module 004 to the threshold voltage is sped up and the discharging period is shortened.

As discussed above, according to the pixel circuit of the embodiments of the present invention, the input voltage of the second power supply signal terminal is written into the first control point by the reset module, the input voltage of the third power supply signal terminal is written into the third control point by the compensation module, and the input voltage of the data signal terminal is written into the fourth control point by the drive control module, so that the drive module is discharged under control of the voltages on the first control point, the third control point and the fourth control point, and since the input voltage of the third power supply signal terminal is larger than the difference between the input voltage of the data signal terminal and the threshold voltage of the drive module, and less than the input voltage of the second power supply signal terminal, the voltage on the drive module is pre-compensated utilizing the voltage pre-compensation principle, thereby discharging of the drive module to the potential Vth is sped up, the time for discharging the drive module to the potential Vth is shortened, therefore it is ensured that the drive module can be discharged completely within a short period.

Figure 2:
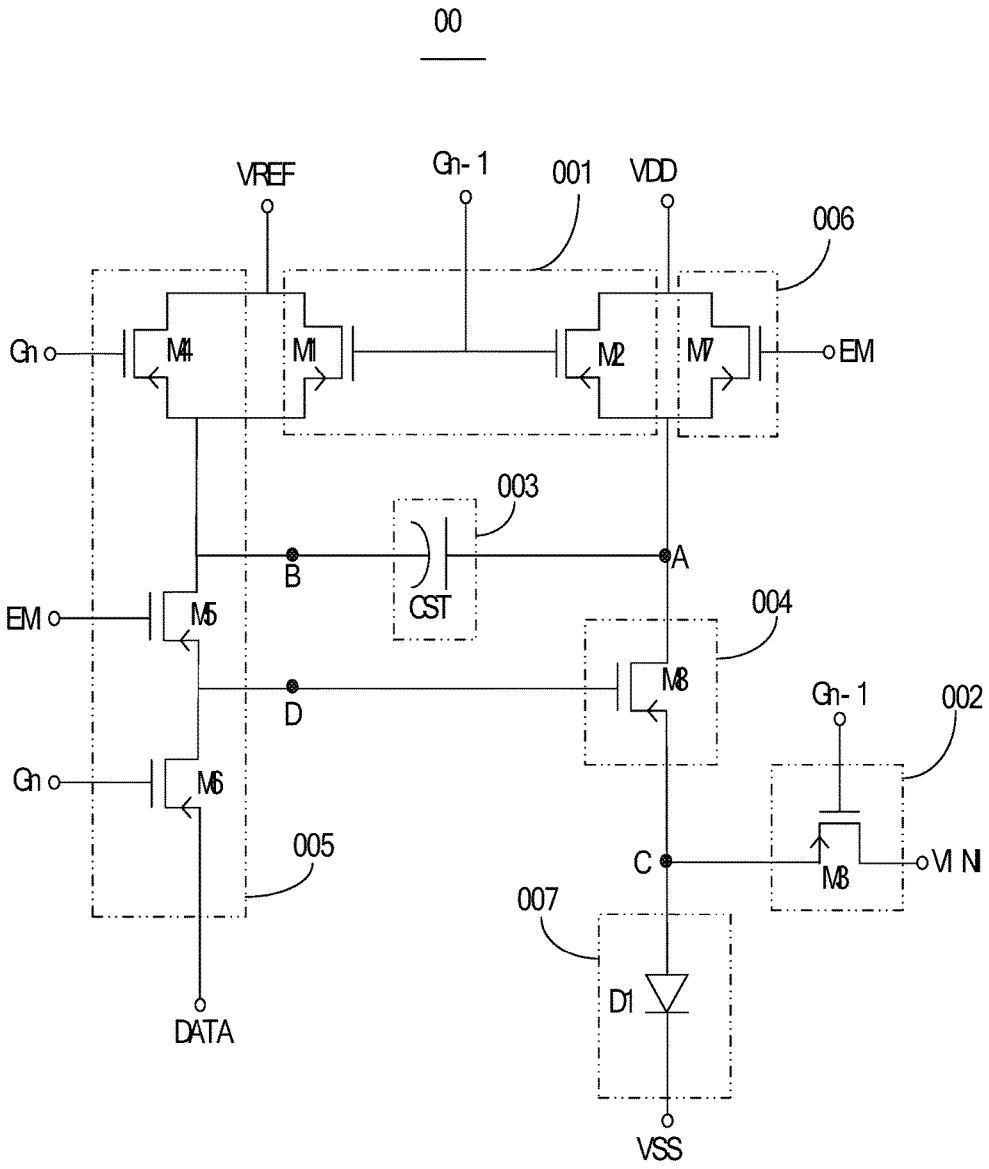
FIG. 2 is a schematic structural view of another pixel circuit according to an embodiment of the present invention.

Furthermore, as shown in FIG. 2, the present invention provides another pixel circuit 00, wherein the reset module 001 may comprise: a first transistor M1 and a second transistor M2. Specifically, a first electrode of the first transistor M1 is connected to the first power supply signal terminal VREF, a second electrode of the first transistor M1 is connected to the second control point B, and a gate of the first transistor M1 is connected to the first control signal terminal Gn-1. A first electrode of the second transistor M2 is connected to the second power supply signal terminal VDD, a second electrode of the second transistor M2 is connected to the first control point A, and a gate of the second transistor M2 is connected to the first control signal terminal Gn-1.

The compensation module 002 may comprise: a third transistor M3. For example, a first electrode of the third transistor M3 is connected to the third power supply signal terminal VINI, a second electrode of the third transistor M3 is connected to the third control point C, and a gate of the third transistor M3 is connected to the first control signal terminal Gn-1.

The drive control module 005 may comprise: a fourth transistor M4, a fifth transistor M5 and a sixth transistor M6. Specifically, a first electrode of the fourth transistor M4 is connected to the first power supply signal terminal VREF, a second electrode of the fourth transistor M4 is connected to the second control point B, and a gate of the fourth transistor M4 is connected to the third control signal terminal Gn. A first electrode of the fifth transistor M5 is connected to the second control point B, a second electrode of the fifth transistor M5 is connected to the fourth control point D, and a gate of the fifth transistor M5 is connected to the second control signal terminal EM. A first electrode of the sixth transistor M6 is connected to the fourth control point D, a second electrode of the sixth transistor M6 is connected to the data signal terminal DATA, and a gate of the sixth transistor M6 is connected to the third control signal terminal Gn.

The power supply module 006 may comprise: a seventh transistor M7. A first electrode of the seventh transistor M7 is connected to the second power supply signal terminal VDD, a second electrode of the seventh transistor M7 is connected to the first control point A, and a gate of the seventh transistor M7 is connected to the second control signal terminal EM.

The drive module 004 may comprise: an eighth transistor M8. The threshold voltage of the drive module 004 is the threshold voltage Vth of the eighth transistor M8. Specifically, a first electrode of the eighth transistor M8 is connected to the first control point A, a second electrode of the eighth transistor M8 is connected to the third control point C, and a gate of the eighth transistor M8 is connected to the fourth control point D.

The energy storage module 003 comprises: a capacitor CST. One terminal of the capacitor CST is connected to the first control point A, and the other terminal of the capacitor CST is connected to the second control point B.

The light emitting module 007 may comprise: an organic light emitting diode D1, one terminal of the organic light emitting diode D1 is connected to the third control point C, and the other terminal of the organic light emitting diode D1 is connected to the fourth power supply signal terminal VSS.

It should be noted that, all of the first transistor M1, the second transistor M2, the third transistor M3, the fourth transistor M4, the fifth transistor M5, the sixth transistor M6, the seventh transistor M7 and the eighth transistor M8 can be N-type transistors, or all of them can be P-type transistors. When all of the first transistor M1, the second transistor M2, the third transistor M3, the fourth transistor M4, the fifth transistor M5, the sixth transistor M6, the seventh transistor M7 and the eighth transistor M8 are P-type transistors, the first electrodes of the first transistor M1, the second transistor M2, the third transistor M3, the fourth transistor M4, the fifth transistor M5, the sixth transistor M6, the seventh transistor M7 and the eighth transistor M8 are the sources, and the second electrodes of the first transistor M1, the second transistor M2, the third transistor M3, the fourth transistor M4, the fifth transistor M5, the sixth transistor M6, the seventh transistor M7 and the eighth transistor M8 are the drains.

Optionally, the first power supply signal terminal VREF is grounded, and at this time, the input voltage of the first power supply signal terminal VREF is zero.

Generally, according to the pixel circuit provided by the embodiments of the present invention, the input voltage of the second power supply signal terminal is written into the first control point by the reset module, the input voltage of the third power supply signal terminal is written into the third control point by the compensation module, the input voltage of the data signal terminal is written into the fourth control point by the drive control module, so that the drive module is discharged under control of the voltages on the first control point, the third control point and the fourth control point, and since the input voltage of the third power supply signal terminal is larger than the difference between the input voltage of the data signal terminal and the threshold voltage of the drive module, and less than the input voltage of the second power supply signal terminal, the voltage on the drive module is pre-compensated utilizing the voltage pre-compensation principle, thereby discharging of the drive module to the potential Vth is sped up, the time for discharging the drive module to the potential Vth is shortened, therefore it is ensured that the drive module can be discharged completely within a short period.

According to an embodiment of the present invention, there is provided a driving method for the pixel circuit 00 shown in FIG. 1 or 2, and the pixel circuit 00 may comprise: the reset module 001, the compensation module 002, the energy storage module 003, the drive module 004, the drive control module 005, the power supply module 006 and the light emitting module 007. The driving method may comprise the following steps:

Step 301, a turning on control signal is input to the first control signal terminal Gn-1, a first voltage is input to the first power supply signal terminal VREF, a second voltage is input to the second power supply signal terminal VDD, and a third voltage is input to the third power supply signal terminal VINI, so that the first voltage is written into the second control point B, the second voltage is written into the first control point A, and the third voltage is written into the third control point C, wherein the third voltage is larger than the difference between a data voltage and the threshold voltage of the drive module 004, and less than the second voltage.

Step 302, a turning off control signal is input to the first control signal terminal Gn-1, a turning on control signal is input to the third control signal terminal Gn, the data voltage is input to the data signal terminal DATA, the first voltage is input to the first power supply signal terminal VREF, so that the data voltage is written into the fourth control point D, the first voltage is written into the second control point B, and the drive module 004 is discharged via the light emitting module 007 under control of the voltages on the first control point A and the fourth control point D.

Step 303, a turning off control signal is input to the third control signal terminal Gn, a turning on control signal is input to the second control signal terminal EM, and a second voltage is input to the second power supply signal terminal VDD, so that the second voltage is written into the first control point A, and the light emitting module 007 is driven by the current of the drive module 004 to emit light.

As above, according to the driving method for the pixel circuit provided by the embodiment of the present invention, the input voltage of the second power supply signal terminal is written into the first control point by the reset module, the input voltage of the third power supply signal terminal is written into the third control point by the compensation module, the input voltage of the data signal terminal is written into the fourth control point by the drive control module, so that the drive module is discharged under control of the voltages on the first control point, the third control point and the fourth control point, and since the input voltage of the third power supply signal terminal is larger than the difference between the input voltage of the data signal terminal and the threshold voltage of the drive module, and less than the input voltage of the second power supply signal terminal, the voltage on the drive module is pre-compensated utilizing the voltage pre-compensation principle, thereby discharging of the drive module to the potential Vth is sped up, the time for discharging the drive module to the potential Vth is shortened, therefore it is ensured that the drive module can be discharged completely within a short period.

For example, as shown in FIG. 2, the reset module 001 may comprise the first transistor M1 and the second transistor M2, the compensation module 002 may comprise the third transistor M3, the drive control module 005 may comprise the fourth transistor M4, the fifth transistor M5 and the sixth transistor M6, the power supply module 006 may comprise the seventh transistor M7, the drive module 004 may comprise the eighth transistor M8, the threshold voltage of the drive module 004 is the threshold voltage Vth of the eighth transistor M8, the energy storage module 003 may comprise the capacitor CST, and the light emitting module 007 may comprise the organic light-emitting diode D1.

When the turning on control signal is input to the first control signal terminal Gn-1, the first transistor M1, the second transistor M2 and the third transistor M3 are turned on. When the turning off control signal is input to the first control signal terminal Gn-1, the first transistor M1, the second transistor M2 and the third transistor M3 are turned off. When the turning on control signal is input to the third control signal terminal Gn, the fourth transistor M4 and the sixth transistor M6 are turned on. When the turning off control signal is input to the third control signal terminal Gn, the fourth transistor M4 and the sixth transistor M6 are turned off. When the turning on control signal is input to the second control signal terminal EM, the fifth transistor M5 and the seventh transistor M7 are turned on.

It should be noted that, all of the first transistor M1, the second transistor M2, the third transistor M3, the fourth transistor M4, the fifth transistor M5, the sixth transistor M6, the seventh transistor M7 and the eighth transistor M8 can be N-type transistors, or all of them can be P-type transistors. When all of the first transistor M1, the second transistor M2, the third transistor M3, the fourth transistor M4, the fifth transistor M5, the sixth transistor M6, the seventh transistor M7 and the eighth transistor M8 are P-type transistors, the first electrodes of the first transistor M1, the second transistor M2, the third transistor M3, the fourth transistor M4, the fifth transistor M5, the sixth transistor M6, the seventh transistor M7 and the eighth transistor M8 are the sources, and the second electrodes of the first transistor M1, the second transistor M2, the third transistor M3, the fourth transistor M4, the fifth transistor M5, the sixth transistor M6, the seventh transistor M7 and the eighth transistor M8 are the drains.

When the first transistor M1, the second transistor M2, the third transistor M3, the fourth transistor M4, the fifth transistor M5, the sixth transistor M6, the seventh transistor M7 and the eighth transistor M8 are P-type transistors, the timing sequence of the control signal includes:

a first phase: the first control signal terminal Gn-1 is at a low level, the second control signal terminal EM and the third control signal terminal Gn are at a high level, the first voltage is input to the first power supply signal terminal VREF, the second voltage is input to the second power supply signal terminal VDD, the third voltage is input to the third power supply signal terminal VINI, and the third voltage is larger than the threshold voltage of the eighth transistor M8, and less than the second voltage;

a second phase: the third control signal terminal Gn is at a low level, the first control signal terminal Gn-1 and the second control signal terminal EM are at a high level, a data voltage is input to the data signal terminal DATA, and the first voltage is input to the first power signal terminal VREF;

a third stage: the second control signal terminal EM is at a low level, the first control signal terminal Gn-1 and the third control signal terminal Gn are at a high level, and the second voltage is input to the second power signal terminal VDD.

Figure 3:
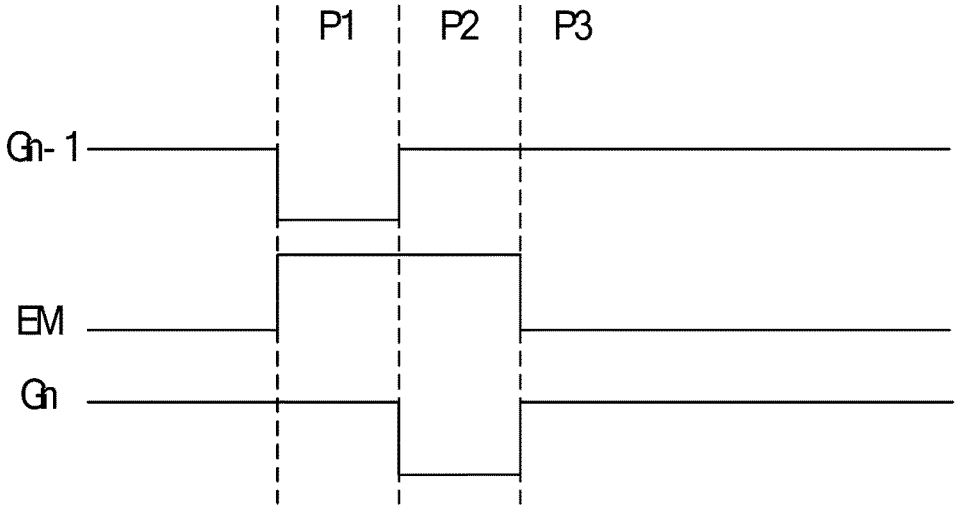
FIG. 3 is a timing chart of a control signal according to an embodiment of the present invention.

Specifically, taking a case where the first transistor M1, the second transistor M2, the third transistor M3, the fourth transistor M4, the fifth transistor M5, the sixth transistor M6, the seventh transistor M7 and the eighth transistor M8 are P-type transistors as an example, during operation of the pixel circuit as shown in FIG. 2, the operation procedure can be divided into three phases including: a reset phase, a compensation potential writing phase and a light emitting phase. FIG. 3 is a timing chart of the respective control signal lines during operation of the pixel circuit shown in FIG. 2. As shown in FIG. 3, the reset phase, the compensation potential writing phase and the light emitting phase are represented using P1, P2 and P3 respectively.

Figure 4:
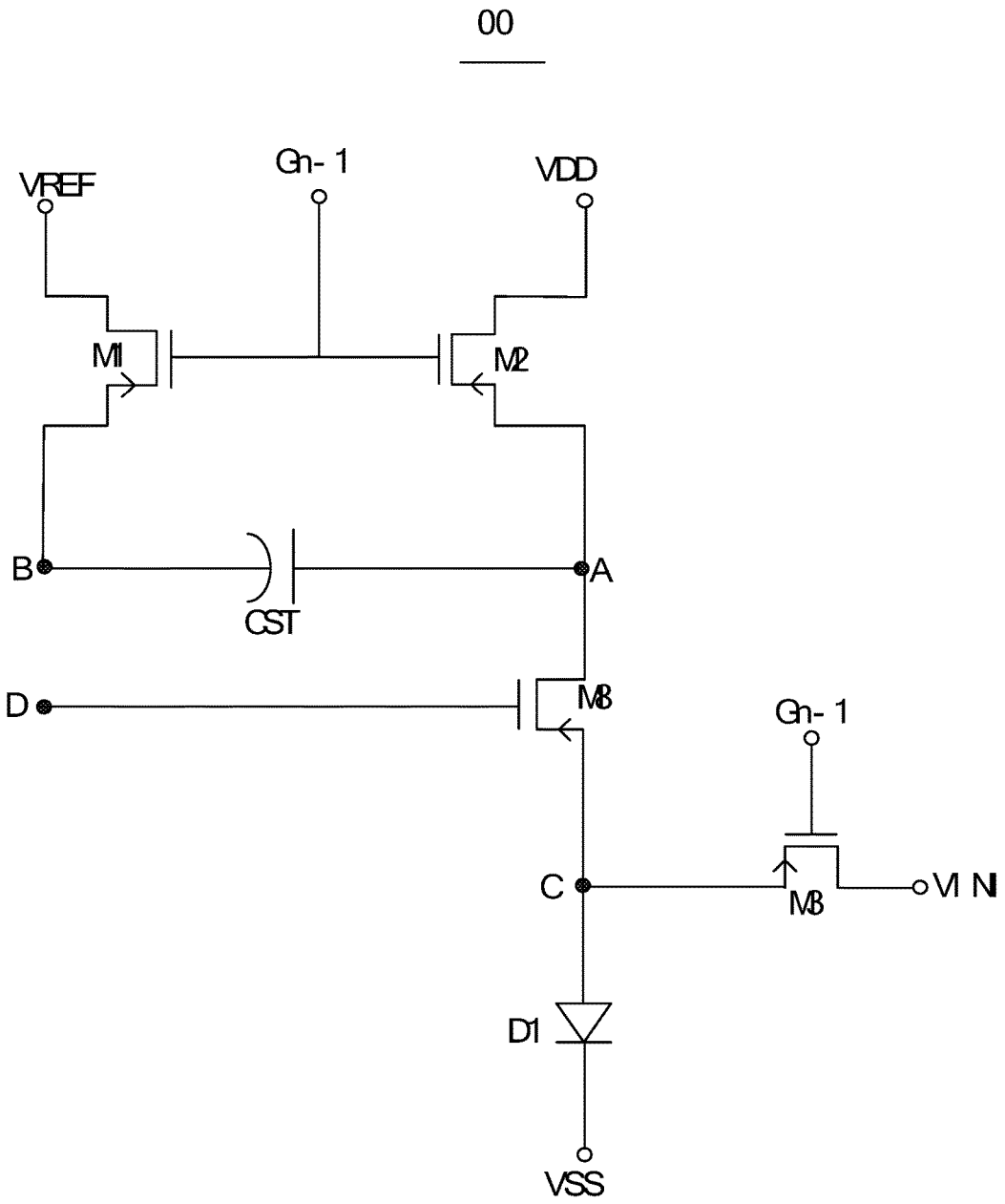
FIG. 4 is an equivalent circuit diagram of a pixel circuit according to an embodiment of the present invention.

Specifically, P1 is a reset phase, an equivalent circuit of which is shown in FIG. 4. In the reset phase, the first control signal terminal Gn-1 is at a low level, the second control signal terminal EM and the third control signal terminal Gn are at a high level, the first voltage Vref is input to the first power supply signal terminal VREF, the second voltage Vdd is input to the second power supply signal terminal VDD, the third voltage Vini is input to the third power supply signal terminal VINI, the third voltage Vini is larger than the threshold voltage Vth of the eighth transistor M8 and less than the second voltage Vdd. At this time, the first transistor M1, the second transistor M2 and the third transistor M3 are turned on, the first voltage Vref input to the first power supply signal terminal VREF is written into the second control point B, the second voltage Vdd input to the second power supply signal terminal VDD is written into the first control point A, and the third voltage Vini input to the third power supply signal terminal VINI is written into the third control point C.

Figure 5:
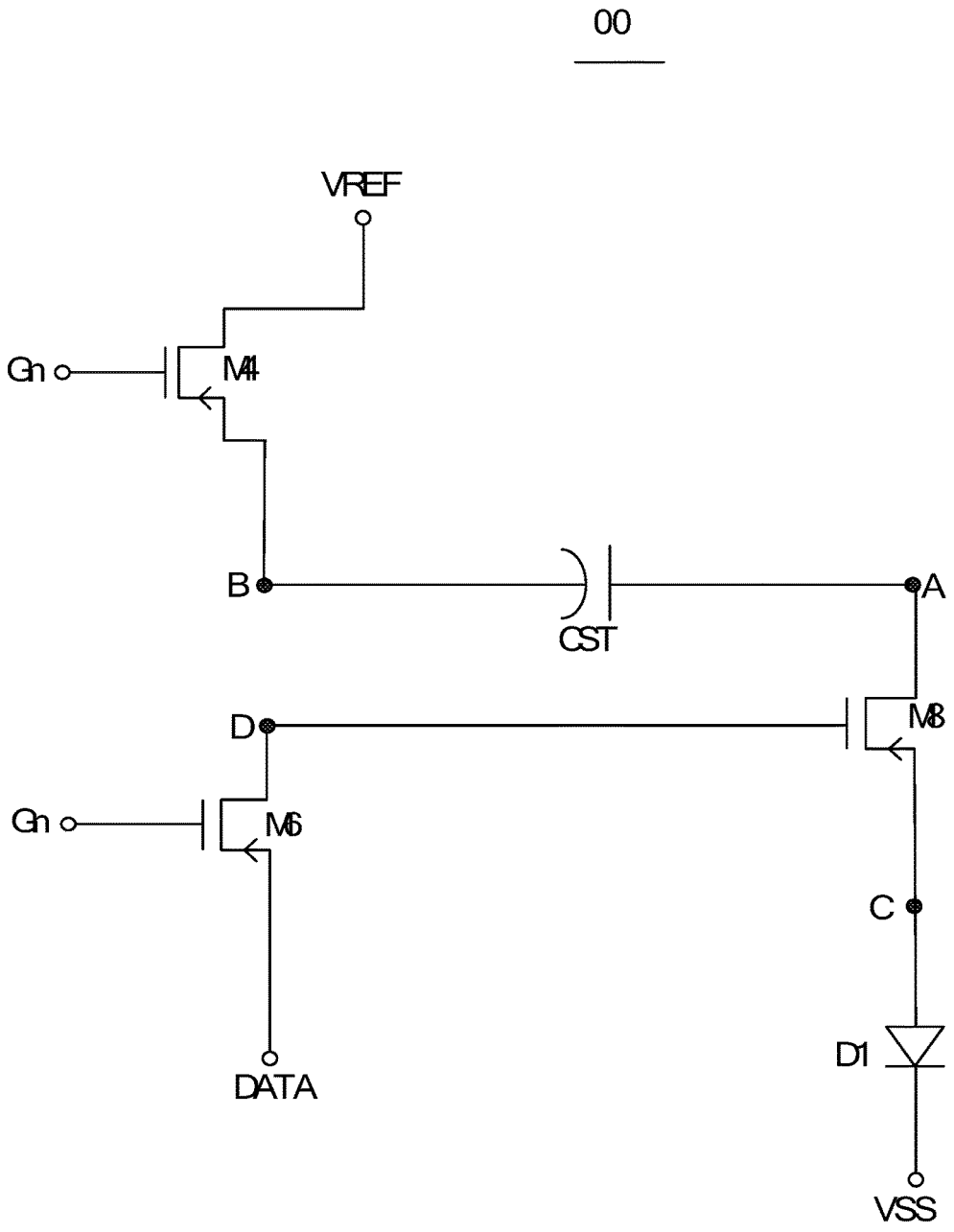
FIG. 5 is an equivalent circuit diagram of another pixel circuit according to an embodiment of the present invention.

P2 is the compensation potential writing phase, an equivalent circuit of which is shown in FIG. 5. In the compensation potential writing phase, the third control signal terminal Gn is at a low level, the first control signal terminal Gn-1 and the second control signal terminal EM are at a high level, a data voltage Data is input to the data signal terminal DATA, the first voltage Vref is input to the first power signal terminal VREF. At this time, the fourth transistor M4 and the sixth transistor M6 are turned on, the first transistor M1, the second transistor M2 and the third transistor M3 are turned off, the data voltage Data input to the data signal terminal DATA is written into the fourth control point D, the first voltage Vref input to the first power signal terminal VREF is written into the second control point B, so that the eighth transistor M8 is discharged via the organic light emitting diode D1 under control of the voltages on the first control point A and the fourth control point D, until the eighth transistor M8 is turned off.

The voltage on the first control point A is the second voltage Vdd input to the second power supply signal terminal VDD, the voltage on the third control point C is the third voltage Vini input to the third power supply signal terminal VINI. Since in the reset phase, the third voltage Vini input to the third power supply signal terminal VINI is larger than the threshold voltage Vth of the eighth transistor M8 and less than the second voltage Vdd input to the second power supply signal terminal VDD, a voltage difference between the first control point A and the third control point C can be formed so as to facilitate discharging from the first control point A to the third control point C. And the voltage difference between the first control point A and the third control point C is less than the voltage difference between the first control point A and the third control point C according to the prior art solutions. Compared to the prior art solutions, according to the voltage pre-compensation principle, the voltage on the first control point A is changed from the second voltage Vdd input to the second power supply signal terminal VDD to Data-Vth more rapidly, the required period is shortened, therefore in a case of high resolution application, the drive transistor can be discharged to a potential Vth within a short period. At this time, the potentials at the two terminals of the capacitor CST are the voltage on the second control point B (i.e. the first voltage Vref) and the voltage on the first control point A (i.e. Data−Vth) respectively, therefore the voltage difference between the two terminals of the capacitor CST is Vref−(Data−Vth).

Figure 6:
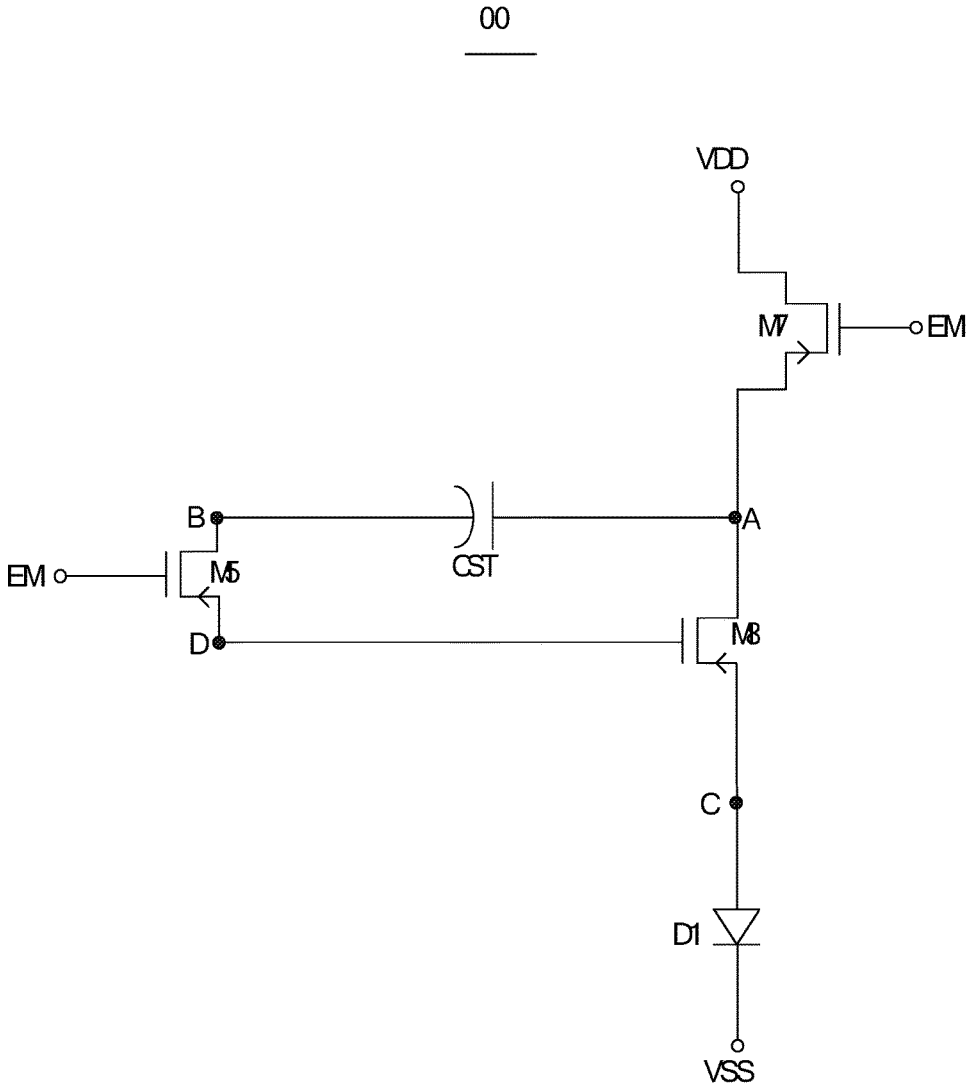
FIG. 6 is an equivalent circuit diagram of still another pixel circuit according to an embodiment of the present invention.

P3 phase is the light emitting phase, an equivalent circuit of which is shown in FIG. 6. In the light emitting phase, the second control signal terminal EM is at a low level, the first control signal terminal Gn-1 and the third control signal terminal Gn are at a high level, the second voltage Vdd is input to the second power signal terminal VDD. At this time, the fourth transistor M4 and the sixth transistor M6 are turned off, the fifth transistor M5 and the seventh transistor M7 are turned on, and the second voltage Vdd input to the second power signal terminal VDD is written into the first control point A. Since the second voltage Vdd is written into the first control point A in the light emitting phase, thus the voltage on the first control point A is Vdd. The fifth transistor M5 is turned on, so that the voltages on the second control point B and the fourth control point D are identical. In order to maintain the voltage difference between the two terminals of the capacitor CST to be the voltage difference of Vref−(Data−Vth) in the previous phase, the voltages on the second control point B and the fourth control point D become Vdd+Vref−(Data−Vth), i.e. the gate voltage of the eighth transistor M8 is Vdd+Vref−(Data−Vth), the source voltage of the eighth transistor M8 is the voltage on the first control point (Vdd). At this time the eighth transistor M8 is in a saturation state, the current flows through the eighth transistor M8 is $$Ids = \frac{1}{2}\cdot K\cdot(Vgs - Vth)^2 = \frac{1}{2}\cdot K\cdot\{Vdd + Vref - (\text{Data} - Vth) - Vdd - Vth\}^2 = \frac{1}{2}\cdot K\cdot(Vref - \text{Data})^2;$$

wherein $$K = \frac{W}{L}\cdot C\cdot\mu$$

Specifically, μ is the carrier mobility of the eighth transistor M8, C is the capacitance of the gate insulating layer of the eighth transistor M8, and W/L is the width to length ratio for the eighth transistor M8. The organic light emitting diode D1 is driven to emit light with the current flowing through the eighth transistor M8. It can be seen that, during normal operation of the organic light emitting diode D1, the current flowing through the eighth transistor M8 and its threshold voltage Vth is independent of the voltage Vdd input to the second power supply signal terminal VDD, but only related to the data voltage Data input to the data signal terminal DATA and the first voltage Vref input to the first power supply signal terminal VREF, thereby the problem of incomplete discharge due to the short discharging time of the eighth transistor M8, which causes the display brightness of the organic light emitting diode D1 to be different from a preset display brightness, can be avoided, and the display performance can be improved.

Optionally, the first power supply signal terminal VREF can be grounded, at this time the first voltage Vref input to the first power supply signal terminal VREF is zero, the current flowing through the eighth transistor M8 and the organic light emitting diode D1 is only related to the data voltage Data input to the data signal terminal DATA, thereby the problem that the display brightness of the organic light emitting diode D1 is different from a preset display brightness caused by the first voltage Vref is avoided, the display performance can be further improved. As an example, since the third power supply signal terminal VINI and the pixel circuit cannot form a loop, the voltage drop problem caused by the third voltage Vini input to the third power supply signal terminal VINI can be avoided.

It should be noted that, above embodiments are exemplified where the first transistor M1, the second transistor M2, the third transistor M3, the fourth transistor M4, the fifth transistor M5, the sixth transistor M6, the seventh transistor M7 and the eighth transistor M8 are P-type transistors. Of course, the first transistor M1, the second transistor M2, the third transistor M3, the fourth transistor M4, the fifth transistor M5, the sixth transistor M6, the seventh transistor M7 and the eighth transistor M8 may be N-type transistors. When the first transistor M1, the second transistor M2, the third transistor M3, the fourth transistor M4, the fifth transistor M5, the sixth transistor M6, the seventh transistor M7 and the eighth transistor M8 are N-type transistors, the timing sequence of the respective control signal lines will be opposite to that shown in FIG. 3 (having a phase difference of 180 degrees).

As above, according to the driving method for the pixel circuit provided by the embodiments of the present invention, the input voltage of the second power supply signal terminal is written into the first control point by the reset module, the input voltage of the third power supply signal terminal is written into the third control point by the compensation module, and the input voltage of the data signal terminal is written into the fourth control point by the drive control module, so that the drive module is discharged under control of the voltages on the first control point, the third control point and the fourth control point, and since the input voltage of the third power supply signal terminal is larger than the difference between the input voltage of the data signal terminal and the threshold voltage of the drive module, and less than the input voltage of the second power supply signal terminal, the voltage on the drive module is pre-compensated utilizing the voltage pre-compensation principle, thereby discharging of the drive module to the potential Vth is sped up, the time for discharging the drive module to the potential Vth is shortened, therefore it is ensured that the drive module can be discharged completely within a short period.

Embodiments of the present invention also provide a display device comprising a pixel circuit which can be the pixel circuit 00 as shown in FIG. 1 or FIG. 2.

As above, in the display device provided by the embodiments of the present invention, the input voltage of the second power supply signal terminal is written into the first control point by the reset module, the input voltage of the third power supply signal terminal is written into the third control point by the compensation module, and the input voltage of the data signal terminal is written into the fourth control point by the drive control module, so that the drive module is discharged under control of the voltages on the first control point, the third control point and the fourth control point, and since the input voltage of the third power supply signal terminal is larger than the difference between the input voltage of the data signal terminal and the threshold voltage of the drive module, and less than the input voltage of the second power supply signal terminal, the voltage on the drive module is pre-compensated utilizing the voltage pre-compensation principle, thereby discharging of the drive module to the potential Vth is speed up, the time for discharging the drive module to the potential Vth is shortened, therefore it is ensured that the drive module can be discharged completely within a short period.

The foregoing embodiments are only preferred embodiments of the present invention, and the present invention is not limited thereto. Various variations, equivalent replacements and improvements made without departing from the spirit and essence of the present invention should fall into the protection scope of the present invention.

The invention claimed is:

1. A pixel circuit comprising: a reset module, a compensation module, an energy storage module, a drive module, a drive control module, a power supply module and a light emitting module, wherein the reset module is connected to a first power supply signal terminal, a second power supply signal terminal, a first control signal terminal, a first control point and a second control point, and is configured for writing an input voltage of the first power supply signal terminal into the second control point and writing an input voltage of the second power supply signal terminal into the first control point according to a control signal input to the first control signal terminal;

the compensation module is connected to the first control signal terminal, a third power supply signal terminal and a third control point, and is configured for writing an input voltage of the third power supply signal terminal into the third control point according to the control signal input to the first control signal terminal;

the drive control module is connected to the first power supply signal terminal, a second control signal terminal, a third control signal terminal, a data signal terminal, the second control point and a fourth control point, and is configured for writing an input voltage of the data signal terminal into the fourth control point according to a control signal input to the third control signal terminal;

the power supply module is connected to the second power supply signal terminal, the second control signal terminal and the first control point, and is configured for providing the voltage on the first power supply signal terminal to the first control point according to a control signal input to the second control signal terminal;

the drive module is connected to the first control point, the third control point and the fourth control point, and is discharged under control of the voltages on the first control point, the third control point and the fourth control point;

the energy storage module is connected to the first control point and the second control point, and is configured for storing the voltages on the first control point and the second control point; and the light emitting module is connected to the third control point and the fourth power supply signal terminal, and is configured for emitting light under control of the voltages on the third control point and the fourth power supply signal terminal;

wherein the input voltage of the third power supply signal terminal is larger than a difference between the input voltage of the data signal terminal and a threshold voltage of the drive module, and is less than the input voltage of the second power supply signal terminal.

2. The pixel circuit according to claim 1, wherein the reset module comprises a first transistor and a second transistor, a first electrode of the first transistor is connected to the first power supply signal terminal, a second electrode of the first transistor is connected to the second control point, and a gate of the first transistor is connected to the first control signal terminal; and a first electrode of the second transistor is connected to the second power supply signal terminal, a second electrode of the second transistor is connected to the first control point, and a gate of the second transistor is connected to the first control signal terminal.

3. The pixel circuit according to claim 1, wherein the compensation module comprises a third transistor, and a first electrode of the third transistor is connected to the third power supply signal terminal, a second electrode of the third transistor is connected to the third control point, and a gate of the third transistor is connected to the first control signal terminal.

4. The pixel circuit according to claim 1, wherein the drive control module comprises a fourth transistor, a fifth transistor and a sixth transistor, a first electrode of the fourth transistor is connected to the first power supply signal terminal, a second electrode of the fourth transistor is connected to the second control point, and a gate of the fourth transistor is connected to the third control signal terminal;

a first electrode of the fifth transistor is connected to the second control point, a second electrode of the fifth transistor is connected to the fourth control point, and a gate of the fifth transistor is connected to the second control signal terminal; and a first electrode of the sixth transistor is connected to the fourth control point, a second electrode of the sixth transistor is connected to the data signal terminal, and a gate of the sixth transistor is connected to the third control signal terminal.

5. The pixel circuit according to claim 1, wherein the power supply module comprises a seventh transistor, and a first electrode of the seventh transistor is connected to the second power supply signal terminal, a second electrode of the seventh transistor is connected to the first control point, and a gate of the seventh transistor is connected to the second control signal terminal.

6. The pixel circuit according to claim 1, wherein the drive module comprises an eighth transistor, and the threshold voltage of the drive module is a threshold voltage of the eighth transistor, and a first electrode of the eighth transistor is connected to the first control point, a second electrode of the eighth transistor is connected to the third control point, and a gate of the eighth transistor is connected to the fourth control point.

7. The pixel circuit according to claim 1, wherein the energy storage module comprises a capacitor, and one terminal of the capacitor is connected to the first control point, and the other terminal of the capacitor is connected to the second control point.

8. The pixel circuit according to claim 1, wherein the light emitting module comprises an organic light emitting diode, one terminal of the organic light emitting diode is connected to the third control point, and the other terminal of the organic light emitting diode is connected to the fourth power supply signal terminal.

9. The pixel circuit according to claim 1, wherein the first power supply signal terminal is grounded.

10. The pixel circuit according to claim 2, wherein the first power supply signal terminal is grounded.

11. The pixel circuit according to claim 3, wherein the first power supply signal terminal is grounded.

12. The pixel circuit according to claim 4, wherein the first power supply signal terminal is grounded.

13. The pixel circuit according to claim 2, wherein all of the transistors are N-type transistors; or all of the transistor are P-type transistors.

14. The pixel circuit according to claim 3, wherein all of the transistors are N-type transistors; or all of the transistor are P-type transistors.

15. The pixel circuit according to claim 4, wherein all of the transistors are N-type transistors; or all of the transistor are P-type transistors.

16. The pixel circuit according to claim 1, wherein when the transistor is a P-type transistor, a first electrode of the transistor is a source, and the second electrode of the transistor is a drain.

17. A driving method for the pixel circuit according to claim 1, comprising the following steps:

inputting, a turning on control signal to the first control signal terminal, a first voltage to the first power supply signal terminal, a second voltage to the second power supply signal terminal, and a third voltage to the third power supply signal terminal, so that the first voltage is written into the second control point, the second voltage is written into the first control point, and the third voltage is written into the third control point;

inputting, a turning off control signal to the first control signal terminal, a turning on control signal to the third control signal terminal, a data voltage to the data signal terminal, and the first voltage to the first power supply signal terminal, so that the data voltage is written into the fourth control point, the first voltage is written into the second control point, and the drive module is discharged via the light emitting module under control of the voltages on the first control point and the fourth control point;

inputting, a turning off control signal to the third control signal terminal, a turning on control signal to the second control signal terminal, and the second voltage to the second power supply signal terminal, so that the second voltage is written into the first control point, and the light emitting module is driven by the current of the drive module to emit light;

wherein the third voltage is larger than a difference between the data voltage and the threshold voltage of the drive module, and is less than the second voltage.

18. The driving method according to claim 17, wherein the reset module comprises a first transistor and a second transistor, the compensation module comprises a third transistor, the drive control module comprises a fourth transistor, a fifth transistor and a sixth transistor, the power supply module comprises a seventh transistor, the drive module comprises an eighth transistor, the energy storage module comprises a capacitor, and the light emitting module comprises an organic light-emitting diode, when the turning on control signal is input to the first control signal terminal, the first transistor, the second transistor and the third transistor are turned on;

when the turning off control signal is input to the first control signal terminal, the first transistor, the second transistor and the third transistor are turned off;

when the turning on control signal is input to the third control signal terminal, the fourth transistor and the sixth transistor are turned on;

when the turning off control signal is input to the third control signal terminal, the fourth transistor and the sixth transistor are turned off; when the turning on control signal is input to the second control signal terminal, the fifth transistor and the seventh transistor are turned on.

19. The driving method according to claim 7, wherein when the transistors are P-type transistors, a timing sequence of the control signal includes:

a first phase: the first control signal terminal is at a low level, the second control signal terminal and the third control signal terminal are at a high level, the first voltage is input to the first power supply signal terminal, the second voltage is input to the second power supply signal terminal, the third voltage is input to the third power supply signal terminal, and the third voltage is larger than the threshold voltage of the eighth transistor, and less than the second voltage;

a second phase: the third control signal terminal is at a low level, the first control signal terminal and the second control signal terminal are at a high level, the data voltage is input to the data signal terminal, the first voltage is input to the first power signal terminal; and a third stage: the second control signal terminal is at a low level, the first control signal terminal and the third control signal terminal are at a high level, and the second voltage is input to the second power signal terminal.

20. A display device comprising the pixel circuit according to claim 1.

* * * * *